United States Patent [19]

Van Valkenburgh

[11] 4,102,433

[45] Jul. 25, 1978

[54] LADDER

[76] Inventor: Leslie Van Valkenburgh, Rte. 42, Westkill, N.Y. 12492

[21] Appl. No.: 769,965

[22] Filed: Feb. 18, 1977

[51] Int. Cl.[2] ..... E06C 1/12

[52] U.S. Cl. ..... 182/164; 182/207

[58] Field of Search ..... 182/163, 164, 40, 41, 182/207–211, 108, 111, 67, 45

[56] References Cited

U.S. PATENT DOCUMENTS

| | | | |
|---|---|---|---|
| 37,470 | 1/1863 | Willis | 182/208 |
| 1,582,793 | 4/1926 | Smith | 182/208 |
| 2,629,532 | 2/1953 | Tupper | 182/163 |
| 3,213,963 | 10/1965 | Vogt | 182/111 |

*Primary Examiner*—Reinaldo P. Machado

*Attorney, Agent, or Firm*—Kenyon & Kenyon, Reilly, Carr & Chapin

[57] ABSTRACT

An extension roof ladder is disclosed having conventional extension ladder sections for use at the side of a building and connected thereto a flexible roof ladder section having a plurality of shorter subsections for use on the near side of a roof and one relatively longer rigid subsection hinged to the top shorter subsection for use on the far side of the roof.

9 Claims, 8 Drawing Figures

1
2
3
7
8
20
30
40
41
42
6

LADDER

BACKGROUND OF THE INVENTION

1. Field of the Invention

The field of the invention described herein is ladders. Specifically, the invention is directed to ladders designed for use on inclined roofs. Still more specifically, the invention relates to an extension ladder, a portion of which can be raised over and onto an inclined roof for use thereon.

2. Description of the Prior Art

The requirements of roof and chimney inspection and repairs, painting, and the erection of roof television antennae have created a demand for a ladder which can readily and safely be placed in position and safely used on an inclined roof by home owners and artisans, including skilled carpenters and masons. The ladder described in this specification is of a type which extends up one side of a gabled or a hip roof, over the roof ridge and down the other side, the angular extension of the ladder over the ridge providing great stability and a safe support for a worker when taking roof measurements, repairing an existing roof, repairing chimneys or flashings, carrying materials up and on the roof for further construction, etc.

The prior art reveals previous attempts to devise roof ladders. U.S. Pat. No. 37,470 which issued on Jan. 20, 1863, shows a single hinged ladder section mounted upon the upper portion of one section of an extension ladder. This patent shows that the upper hinged portion of the hinged ladder section may be held in a straight position by means of a rope until the hinged portion is positioned above the eaves of the roof.

U.S. Pat. No. 836,785 which issued on Nov. 27, 1906 shows a fire ladder in which a rigid roof section is hinged to a conventional standing ladder.

U.S. Pat. No. 2,781,158 which issued on Feb. 12, 1967 shows a roof ladder, independent of a conventional building ladder, in which a rigid upper section can be pivoted with respect to a rigid lower section. In use, the rigid upper section extends beyond the rigid of a gabled roof and the rigid lower section rests on the near incline of the roof. In operation, both sections are locked in a linear relationship until the lower section end is placed near the ridge of the gable. A line is then used to allow the upper section to pivot about the end of the lower section until it is in place on the far incline of the gable.

U.S. Pat. No. 900,232 issued on Oct. 6, 1908 shows ladder sections each having a number of rungs connected to one another by hooks. When used as a roof ladder, the patent teaches that it can have one or more sections disposed beyond the ridge.

It is an object of this invention to provide in a single ladder not only an inexpensive roof ladder which provides for safety and stability when in use on a gabled or hip roof, but also an extension ladder of a design which allows a man acting alone to put the ladder in place on the roof.

One advantageous feature of the invention is that it can be used for the dual purpose of a roof ladder and a conventional ladder. It can be used on a gabled or hip roof regardless of the pitch of the roof. It can accommodate roofs of various sizes. Because it is an extension ladder, it is stored and handled easily.

SUMMARY OF THE INVENTION

The invention is an extension ladder for access to and use on a roof. Conventional ladder sections are provided which provide access to and support from the top of a building, near the eaves of its roof. In combination with the conventional ladder section an extension roof ladder section is slidably attached thereto which may be raised by conventional rope and pulley means onto and in place on a gabled or hip roof. The roof ladder section has two subsections. A top subsection is a rigid ladder subsection hinged to a lower ladder subsection of articulated design. The lower articulated subsection contains relatively short ladder sections, e.g., each having but one rung, which are hinged together. The articulated lower subsection is flexible, enabling it to bend over minor ridges as in a hip roof, and to bend over the eave of the roof so that the end of it remains attached to one or more of the conventional ladder sections at the side of the building. A rope or other means is provided to prevent the top rigid subsection from rotating on its hinges thereby keeping it in a substantially linear relationship with the lower articulated subsection until the top of the lower section is raised to a position approximately at the ridge of the roof. The top rigid subsection can then be released and lowered over the ridge until ultimately coming in contact with the far side of the roof. The top rigid subsection provides stability by cooperating with the articulated subsection in contact with the near side of the roof.

BRIEF DESCRIPTION OF THE DRAWINGS

FIG. 8 shows a ridge support attachment which may be attached to the top ends of the roof ladder section.

DESCRIPTION OF THE INVENTION

Figures 1, 2, 3, 4:
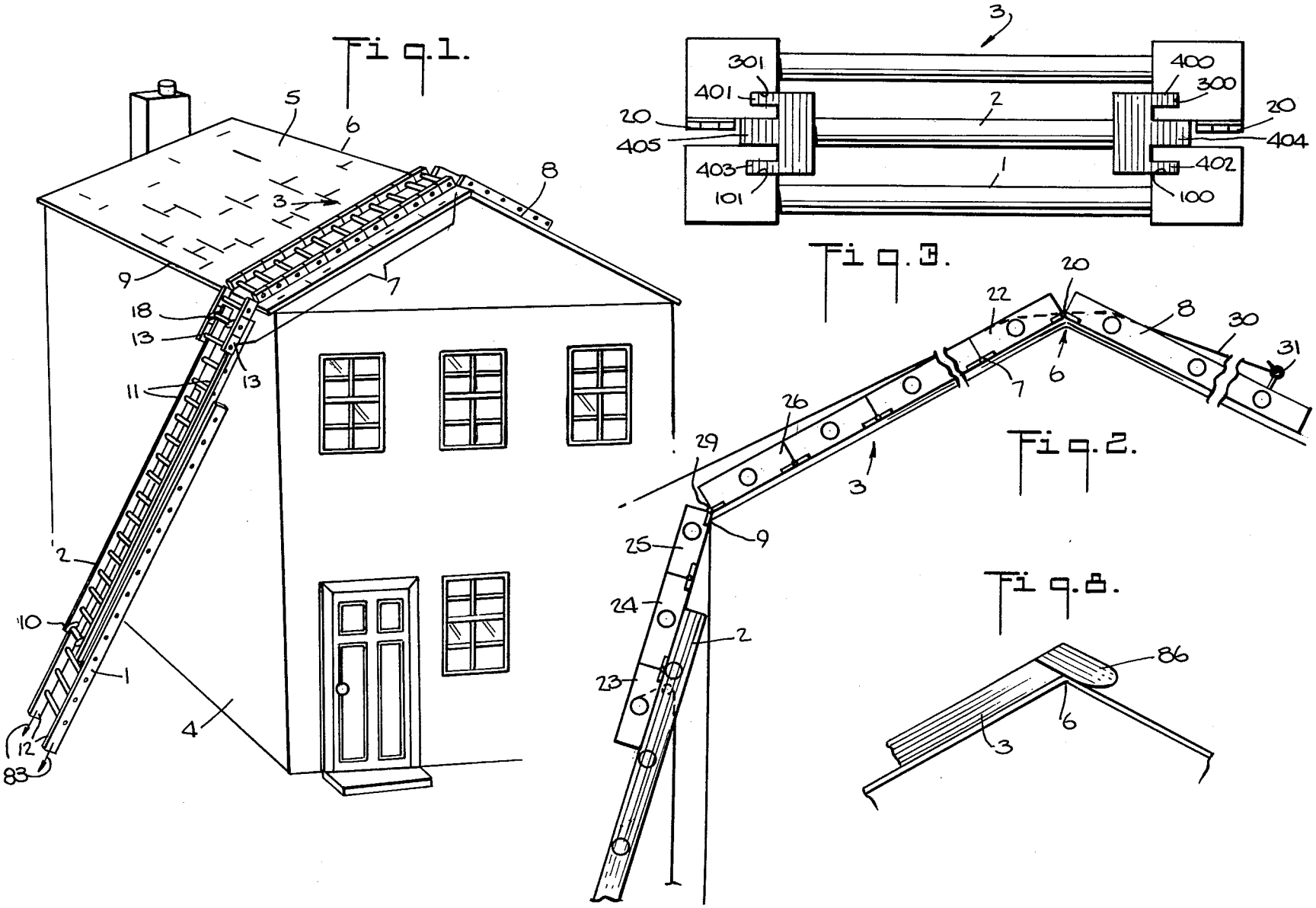
FIG. 1 is an elevation representation of the roof extension ladder in place on a roof of a building.
FIG. 2 shows a side view of the roof ladder section in place on a gabled roof.
FIG. 3 shows how the roof ladder section is slidably attached to a section of a conventional extension ladder.
FIGS. 4, 5, 6 and 7 show the complete ladder in progressive erection stages as the roof section is placed on a gabled roof.

FIG. 1 pictorially illustrates the novel extension roof ladder. Shown therein in an extension ladder with three sections. Sections 1 and 2 are conventional extension ladder sections for use at the side of a building 4. Conventional extension ladder section 1 may be provided with a "foot" connected to the ground end of section 1 in order to provide the ladder with a stable or flat grounding on hard surfaces. Alternatively, if the ladder is used on an earth surface, a spike arrangement 83 may be provided as shown on FIG. 1. Section 2 is raised with respect to section 1 by a conventional rope and pulley system (not illustrated). Such a raising system conventionally employs a rope attached near the bottom of section 2 and passing around a pulley attached near the top of section 2 and down toward the bottom of section 2. By pulling down on the rope, the force is redirected in an upward direction and section 2 slides in an upward direction with respect to section 1. The roof ladder section 3 is similarly raised with respect to section 1. The roof ladder section 3 is similarly raised with respect to section 2.

The roof ladder section 3 is shown in place on top of roof 5. Roof ladder section 3 is shown as having an articulated lower subsection 7 in place on the near side of the roof 5 and a rigid subsection 8 in place on the far side of the roof 5. Rigid subsection 8 is shown angularly connected to articulated subsection 7 at the ridge 6 of the roof 5. The articulated subsection is shown extending over and down from the eave 9 of the roof 5 and is secured to the conventional ladder section 2.

Section 2 is secured in place with respect to section 1 by means of hooks 10 attached near the bottom of section 2 which can be rotated into place over a rung of section 1. Likewise, hooks 18 are provided near the bottom of section 3 to provide support when placed over a rung of section 2.

In a conventional extension ladder, section 2 is advantageously of a different width than section 1 in order that it may easily slide upon section 1. FIG. 1 shows section 2 having a shorter rung width than that of section 1. The side rails 11 of section 2 are of a width to fit between side rails 12 of section 1 thereby allowing section 2 to easily slide upon section 1 when it is being erected by its rope and pulley system. Similarly, side rails 13 of roof ladder section 7 are of a different width (shown wider) than side rails 11 of ladder section 11 so that sliding is facilitated when roof ladder 7 is erected onto the roof.

FIG. 2 shows a side view of the roof ladder section 3 in place on a gabled roof. The rigid upper subsection 8 is shown extending over the far side of the roof from which it is erected. Upper subsection 8 is shown angularly rotated on its hinges 20 which connects it with the articulated lower subsection 7. Upper subsection 8 may advantageously be approximately 6 to 8 feet in length. Although the rigid subsection 8 is shown as the only subsection extending beyond the ridge 6, one or more of the articulated subsections i.e., component subsection 22, may also extend pass the ridge of the roof, allowing the user of the ladder to conveniently control the ladder extent for various sizes of roofs. FIG. 2 shows component articulated sections 23, 24, 25 extending past the eaves of the roof and attached to conventional extension ladder section 2. Articulated section 25 is angularly rotated about its hinges 29 connected to section 26 at the eave of the roof 9.

Each of the component sections (e.g., 22, 23, 24, 25, 26 . . . ) advantageously has but one rung connected to side rails hinged as shown to an adjacent component section. With but one rung for each component section, the component sections are approximately one to two feet in length. It is possible to construct the component sections having more than one rung hereby increasing component section length, but shorter section length is preferred in order to better approximate the near roof distance from ridge 6 to eaves 9.

Also shown on FIG. 2 is rope 30 attached in eyelet 31 near the top of rigid sections 8. Although shown free of tension, rope 30 when placed under tension, causes rigid subsection 8 to become linearly aligned with articulated subsection 7, thereby facilitating ladder erection on the roof.

The ladder can be made of wood; but, because of the weight of wood, light metals or metal alloys are preferred, since the ladder must be raised and slid along and over the roof while the user is perched on conventional ladder section 2.

FIG. 3 illustrates a construction arrangement which allows ladder sections 1, 2 and 3 to be slideably attached to one another. Top section 3 is slidably attached to middle section 2 by complimentary grooves 300, 301 in the side rails of section 3 and flanges 400, 401 in the side rails of section 2. Bottom section 1 is a slidably attached to middle section 2 by complimentary grooves 100, 101 in the side rails of section 1 and flanges 402, 403 in the side rails of section 2. Flanges 404 and 405 in the side rails of middle section 2 act as spacer elements separating upper ladder section 3 and lower ladder section 1. Enough space is provided by spacer elements 404 and 405 to allow passage of hinges 20 attached to the side rails of upper ladder section 3 to clear the side rails of lower ladder section 1 during relative movement of the upper 3 and lower 1 ladder sections. The hinges 20 and center flanges 404 and 405 are placed so that hinges 20 clear center flanges 404 and 405 during relative movement of the upper 1 and middle 2 ladder sections.

The erection of the roof ladder is shown in FIGS. 4, 5, 6 and 7. FIG. 4 shows sections 1, 2, and 3 approximately overlapping one another, the condition appropriate for storage of the ladder.

Figures 4, 5, 6, 7:
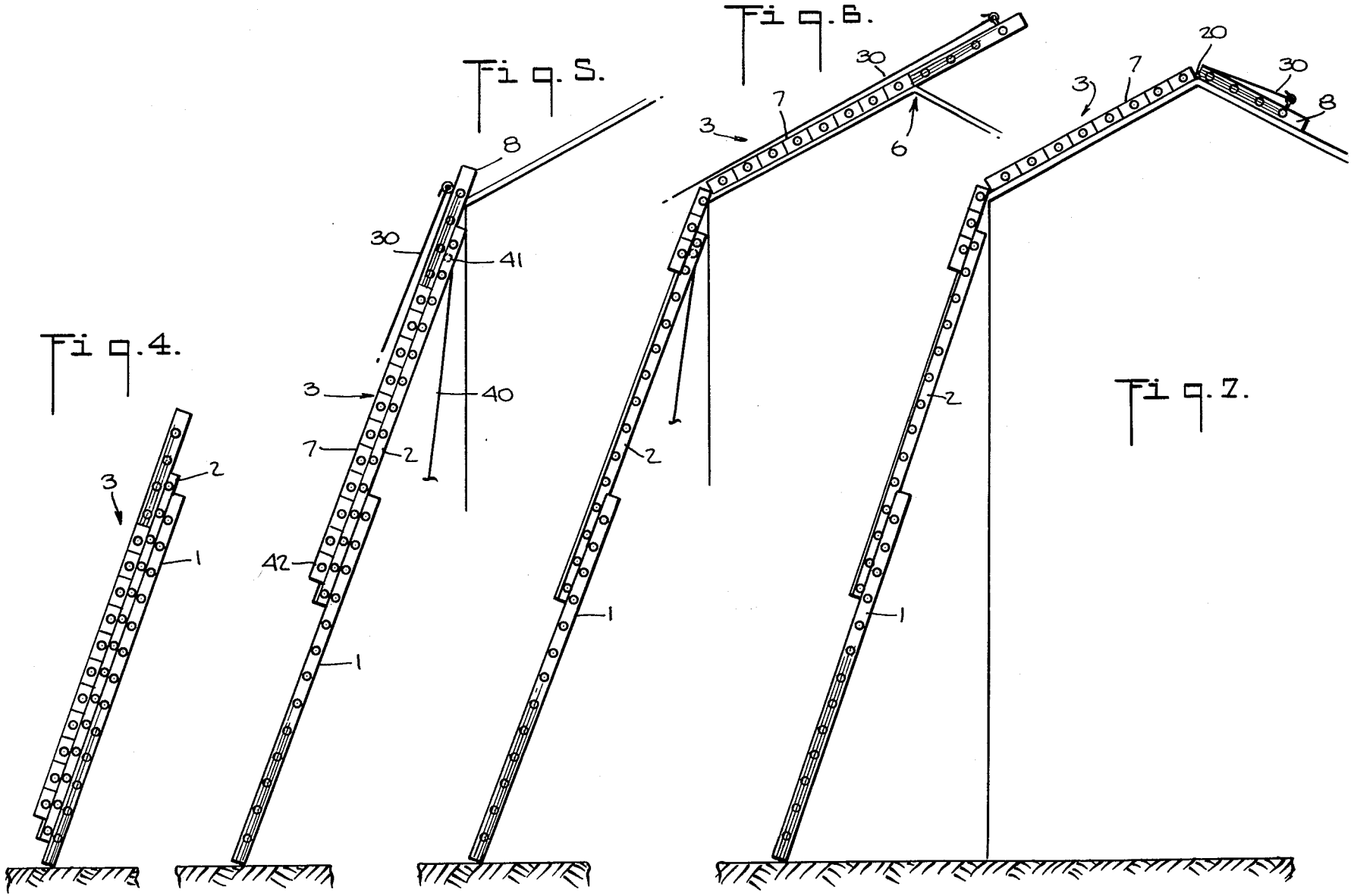

FIG. 5 shows conventional extension ladder section 2 raised to a position near the top of the building just under the eave 9. The rope is shown under tension thereby keeping rigid subsection 8 in a linear relationship with the articulated subsection 7. Rope 40 is used in a rope and pulley system to raise section 3 as it slides upon section 2. Rope 40 passes around pulley 41 and is attached near the bottom of section 3 at point 42.

FIG. 6 shows section 3 at the point where the bottom end of rigid subsection 8 is aligned with the ridge 6 of the roof. Rope 30 keeps rigid subsection 8 in a linear relationship with articulated subsection 7. FIG. 7 shows rigid subsection 8 angularly rotated on its hinge 20 at the roof ridge 6 and resting on the far side of the roof. By slowly releasing the tension on rope 30, the user can control the lowering of rigid subsection 8 onto the far side of the roof 5.

Rigid subsection 8, in place on the far side of the roof, with articulated subsection 7 in place on the near side of the roof, assures that the ladder will be a steady platform for the user to traverse up and down the roof.

The ladder is brought down by reversing the erection steps described above.

FIG. 8 shows a ridge support attachment 86 which may be attached to the top ends of upper ladder section 3 for advantageous use when the upper ladder section 3 extends only to the near side of the roof. For this use, ridge support attachment 86 extends over the ridge 6 of the roof and provides support for upper ladder section 3, thereby preventing it from sliding down the near side of the roof.

What is claimed is:

1. A multiple section extension ladder for access to and use on a roof of a building comprising:

a rigid bottom ladder section, the lower side of the length of the bottom ladder section being adapted to face the side of a building when the bottom ladder section extends from the ground to near the eaves of the roof;

a flexible top ladder section adapted for use upon the roof of a building having a plurality of relatively shorter ladder subsections disposed in an end-to-end arrangement and adapted to overlie the upper side of the length of the bottom ladder, a plurality of hinges, the hinges connecting a different pair of adjacent ladder subsections to one another, each hinge having a pivotal axis adjacent the lower side of the flexible top ladder section to enable the shorter ladder subsections to fold about the hinges in a direction extending toward the bottom ladder section and to prevent the shorter ladder subsections from folding in a direction away from the bottom ladder section, one relatively longer rigid ladder subsection adapted to overlie the upper side of the length of the bottom ladder, additional hinges attached to the bottom end portion of the rigid ladder subsection and the top end portion of the shorter ladder subsections, the longer ladder subsection when in place on top of a roof being adapted to extend from the ridge of a roof and down the far side of a roof with respect to the bottom ladder section, the shorter ladder subsections when in place on top of a roof extending along the side of the roof adjacent the bottom ladder section between the ridge and the eaves of the roof wherein one or more of said relatively shorter subsections can extend below the eaves of the roof, means for slidably mounting the lower side of the length of the flexible top ladder section to the upper side of the length of said rigid bottom ladder section in a facing relationship; and means for slidably moving said flexible top ladder section with respect to the rigid bottom ladder section.

2. The extension ladder of claim 1 wherein said rigid ladder section adapted for conventional use at the side of a building is an extension ladder of two or more sections.

3. The extension ladder of claim 1 wherein said means for moving said flexible ladder section is a rope attached near the lower end portion of said flexible ladder section and extending through and around a pulley attached near the upper end portion of said rigid bottom ladder section.

4. The extension ladder of claim 1 wherein said relatively shorter subsections comprise a pair of short side pieces connected by a single ladder rung extending between them.

5. The extension ladder of claim 1 in which each of the plurality of short subsections of the flexible ladder section has a pair of side rails and the bottom ladder section has an additional pair of side rails and in which said means for slidably attaching said flexible ladder section to said rigid ladder section is a pair of grooves disposed in the side rails of the short subsections of said flexible ladder section and a pair of complimentary flanges attached to the additional side rails of said rigid ladder section, said flanges being inserted within said grooves.

6. The extension ladder of claim 2 wherein said rigid ladder section comprises a first rigid section and a second rigid section, and wherein said means for slidably attaching said flexible ladder section to said first section and to said second rigid section is a complimentary flange-groove arrangement of the side rails of the first and second rigid sections and the flexible section, the side rails of the second rigid section each having top, bottom and middle flanges, the side rails of the flexible section and the first rigid section each having a groove complimentary respectively to the top and bottom flanges of the second rigid section side rails, said side rail top flanges of said second rigid section being slidably inserted in said side rail grooves of said flexible section, said side rail bottom flanges of said second rigid section being slidably inserted in said side rail grooves of said first rigid section, and said middle flange of said second rigid section placed between the bottom surfaces of the side rails of the flexible sections and the top surfaces of the side rails of the first rigid section, said middle flanges being of a height greater than the height of said hinges attached on the bottom surfaces of said flexible section side rails thereby providing sufficient space for unobstructed sliding motion between said flexible section and said bottom rigid section.

7. The extension ladder of claim 1 further comprising means for preventing said rigid subsection from rotating on the hinges connected to it and said interconnected shorter subsections, thereby maintaining the rigid subsection and the adjacent interconnected shorter subsections in a substantially linear relationship.

8. The extension ladder of claim 7 wherein said means for preventing said rigid subsection from rotating on the hinges connected to it and said interconnected shorter subsections is a rope attached adjacent the upper end portion of said rigid subsection and extending downwardly with respect to the length of the plurality of interconnected shorter subsections, said rope being of sufficient length to enable the rope to be placed under a downwardly directed tension force for rotating the rigid subsection about the hinged connection between the rigid subsection and the interconnected shorter subsections until said rigid subsection is in substantially the plane of the interconnected subsection, said tension force preventing rotation of said rigid subsection about its hinge and out of the plane of the rigid subsection, thereby maintaining the rigid subsection and the adjacent interconnected subsections in a substantially linear relationship.

9. A multiple section extension ladder for access to and use on a roof of a building comprising:

a rigid bottom ladder section, the lower side of the length of the bottom ladder section being adapted to face the side of a building when the bottom ladder section extends from the ground to near the eaves of the roof;

a flexible top ladder section adapted for use upon the roof of a building having a plurality of ladder subsections disposed in an end-to-end arrangement and adapted to overlie the upper side of the length of the bottom ladder, a plurality of hinges, the hinges connecting a different pair of adjacent ladder subsections to one another, each hinge having a pivotal axis adjacent the lower side of the flexible top ladder section to enable the ladder subsections to fold about the hinges in a direction extending toward the bottom ladder section and to prevent the ladder subsections from folding in a direction away from the bottom ladder section, the ladder subsections when in place on top of a roof extending along the side of the roof adjacent the bottom ladder section between the ridge and the eaves of the roof wherein one or more of said relatively shorter subsections can extend below the eaves of the roof, means for slidably mounting the lower side of the length of the flexible top ladder section to the upper side of the length of said rigid bottom ladder section in a facing relationship; and means for slidably moving said flexible top ladder section with respect to the rigid bottom ladder section.

* * * * *

UNITED STATES PATENT AND TRADEMARK OFFICE

CERTIFICATE OF CORRECTION

PATENT NO. : 4,102,433

DATED : July 25, 1978

INVENTOR(S) : Leslie Van Valkenburgh

It is certified that error appears in the above-identified patent and that said Letters Patent are hereby corrected as shown below:

Column 1, line 44, delete "rigid" and insert --ridge--

Column 3, line 50, delete "hereby" and insert --thereby--

Column 5, line 57, after "first" insert --rigid--

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*